United States Patent [19]

Kurihara et al.

[11] Patent Number: 4,629,471

[45] Date of Patent: Dec. 16, 1986

[54] OPERATIONAL CONDITION CONTROL DEVICE FOR AN INTERNAL COMBUSTION ENGINE

[75] Inventors: Norimitsu Kurihara, Wako; Hiroshi Gotoh, Asaka; Junichi Miyake, Saitama, all of Japan

[73] Assignee: Honda Giken Kogyo Kabushiki Kaisha, Tokyo, Japan

[21] Appl. No.: 783,389

[22] Filed: Oct. 3, 1985

[30] Foreign Application Priority Data

Dec. 5, 1984 [JP] Japan ..... 59-255744

[51] Int. Cl.[4] ..... F02B 77/08

[52] U.S. Cl. ..... 123/198 DB; 123/41.15; 123/198 D

[58] Field of Search ..... 123/41.15, 198 D, 198 DB

[56] References Cited

U.S. PATENT DOCUMENTS

| | | | |
|---|---|---|---|
| 3,841,291 | 10/1974 | Ludewig et al. | 123/198 D |
| 4,023,358 | 5/1977 | Maurei et al. | 123/198 D |
| 4,147,151 | 4/1979 | Wright | 123/41.15 |
| 4,473,045 | 9/1984 | Bolander et al. | 123/41.15 |
| 4,475,498 | 10/1984 | Hurner | 123/41.15 |

FOREIGN PATENT DOCUMENTS 1065570 4/1967 United Kingdom .

*Primary Examiner*—Ira S. Lazarus

*Attorney, Agent, or Firm*—Armstrong, Nikaido, Marmelstein & Kubovcik

[57] ABSTRACT

An operational condition control device for an internal combustion engine is provided which operates an alarm device when the engine temperature exceeds a predetermined temperature. The operational condition control device comprises a vehicle stop sensor for detecting a stopped condition of the vehicle, a temperature sensor for detecting the engine temperature, and a drive circuit for receiving signals from the sensors and operating the alarm device when the vehicle is in the stopped condition, and the engine temperature exceeds the predetermined temperature. In another aspect of the present invention, there is provided an operational condition control device for an internal combustion engine which operates a fuel cut device when the engine temperature exceeds a predetermined temperature and the vehicle is stopped to thereby stop the engine. In still a further aspect of the present invention there is provided an operational conditional control device for an internal combustion engine which operates an alarm device and a fuel cut device when the engine temperature exceeds a predetermined temperature and the vehicle is stopped.

14 Claims, 2 Drawing Figures

OPERATIONAL CONDITION CONTROL DEVICE FOR AN INTERNAL COMBUSTION ENGINE

BACKGROUND OF THE INVENTION

1. Field of the Invention

This invention relates to an operational condition control device for an internal combustion engine.

2. Description of the Prior Art

In cold weather, a warming-up operation is sometimes carried out after starting an engine in which the accelerator pedal is maintained in a depressed condition to some degree. However, when the warming-up operation is carried out by depressing the accelerator pedal, the vehicle is maintained in a stopped condition, with the accelerator pedal depressed, for a long period of time regardless of the fact that the warming-up operation has been already completed. As a result, engine temperature is increased to temperatures higher than a predetermined temperature, which causes ill effects to the engine as well as a waste of fuel.

SUMMARY OF THE INVENTION

It is an object of the present invention to provide an operational condition control device for an internal combustion engine which gives an alarm and/or cuts fuel to stop the engine when the vehicle is in a stopped condition and the engine temperature is increased to temperatures higher than a predetermined temperature.

To achieve the above-mentioned object, the present invention provides an operational condition control device for an internal combustion engine which operates an alarm device when the engine temperature exceeds a predetermined temperature. The operational condition control device comprises a vehicle stop sensor for detecting a stopped condition of the vehicle, a temperature sensor for detecting the engine temperature, and a drive circuit for receiving signals from the sensors and operating the alarm device when the vehicle is in the stopped condition, and the engine temperature exceeds the predetermined temperature. In another aspect of the present invention, there is provided an operational condition control device for an internal combustion engine which operates a fuel cut device when the engine temperature exceeds a predetermined temperature to thereby stop the engine. The operational condition control device comprises a vehicle stop sensor for detecting a stopped condition of the vehicle, a temperature sensor for detecting the engine temperature, and a drive circuit for receiving signals from the sensors and operating the fuel cut device when the vehicle is in the stopped condition, and the engine temperature exceeds the predetermined temperature. In a further aspect of the present invention, there is provided an operational condition control device for an internal combustion engine which operates an alarm device when the engine temperature exceeds a predetermined temperature, and also operates a fuel cut device to stop the engine. The operational condition control device comprises a vehicle stop sensor for detecting a stopped condition of the vehicle, a temperature sensor for detecting the engine temperature, and a drive circuit for receiving signals from the sensors, operating the alarm device and also operating the fuel cut device after a predetermined time has elapsed after the operation of the alarm device, when the vehicle is in the stopped condition, and the engine temperature exceeds the predetermined temperature.

DETAILED DESCRIPTION OF THE PREFERRED EMBODIMENT

Figure 1:
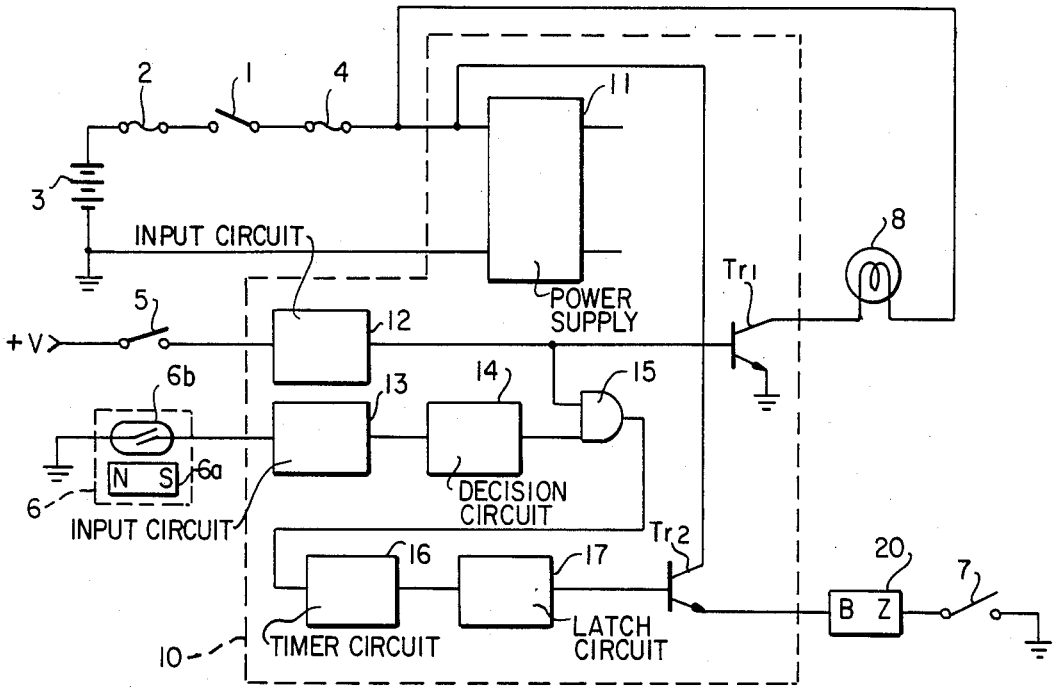
FIG. 1 is a block diagram showing a preferred embodiment of the operation condition control device for an internal combustion engine according to the present invention.

Referring to FIG. 1, one of the terminals of an ignition switch 1 is connected through a fuse 2 to a positive terminal of the battery 3, while the other terminal of switch 1 is connected through a fuse 4 to an input terminal of a power supply 11 in a drive circuit 10. A ground terminal of the power supply 11 is connected to the negative terminal of the battery 3. The power supply 11 serves to convert an input voltage from the battery 3 to a predetermined regulated voltage, and supply an output voltage to input circuits 12 and 13, decision circuit 14, timer circuit 16 and latch circuit 17.

A temperature switch 5 is mounted on the engine block (not shown), to detect the temperature of the engine cooling water and is closed when the temperature of engine cooling water exceeds a predetermined temperature. The temperature sensor 5 is located at a lower position of the engine block so that the temperature of engine cooling water may be detected regardless of a decrease in the amount of cooling water in the cooling system due to the leakage. The predetermined temperature is set at a temperature higher than the operating (closing) temperature of a radiator fan switch (not shown). A predetermined voltage +V is applied to one of terminals of the temperature sensor 5, and the other terminal is connected to an input terminal of the input circuit 12.

An output terminal of the input circuit 12 is connected to the base of transistor $Tr_1$. The collector of the transistor $Tr_1$ is connected through an indication lamp 8 to the output side of the fuse 4, and the emitter is grounded. When the temperature switch 5 is closed, and the voltage +V is applied to the input circuit 12, the input circuit 12 generates a predetermined high level signal.

A vehicular speed sensor 6 comprises a magnet *6a* mounted to an axle, for example, and a lead switch *6b* arranged in the vicinity of the magnet *6a* and adapted to be in an opposed relation with the magnet *6a*. The lead switch *6b* is closed by the magnet *6a*. One end of the lead switch *6b* is grounded, while the other end is connected to the input circuit 13. The lead switch *6b* is closed every time it comes into an opposed relation with the magnet *6a* rotating with the axle, thus, the lead switch *6b* is repeatedly opened and closed according to the vehicular speed. The input circuit 13 generates a low level signal when the lead switch *6b* is opened, and it generates a high level signal when the lead switch *6b* is closed. As a result, an output signal from the input circuit 13 becomes a pulse signal having a pulse width and period which is a function of the vehicular speed. The pulse signal is fed to the decision circuit 14.

The decision circuit 14 measures the period of the pulse signal as received, and determines whether or not the vehicular speed is lower than a predetermined low speed. When the vehicular speed is lower than the predetermined low speed, the decision circuit 14 generates a high level signal. Each of output terminals of the input circuit 12 and the decision circuit 14 are connected to the input terminals of an AND circuit 15, and the output terminal of the AND circuit 15 is connected to the input terminal of a timer circuit 16. The output terminal of the timer circuit 16 is connected to the input terminal of a latch circuit 17, and the output terminal of the latch circuit 17 is connected to the base of a transistor $Tr_2$. The collector of the transistor $Tr_2$ is connected to the input side of the power circuit 11, while the emitter thereof is grounded through a series circuit including an alarm device such as a buzzer 20 and a switch 7.

The timer circuit 16 generates a high level signal, when a high level signal from AND circuit 15 has continued for a predetermined time (a timer setting time). When the high level signal is received by the latch circuit 17, the latch circuit 17 is operated to continue to generate the high level signal.

In a vehicle having an automatic transmission, for example, the switch 7 is designed to be interlocked with a manual shift lever (not shown), and it is closed upon stoppage of the vehicle where the shift lever is operated to a neutral position. Of course, the switch 7 may be designed to be closed when the shift lever is operated to positions other than the neutral position, for example, a parking position. Further, in a vehicle having a manual transmission, the switch 7 is designed to be interlocked with a parking brake (not shown), and is closed when the parking brake is operated. Then, a vehicle stop sensor for detecting a stop condition of the vehicle is formed by the vehicular speed sensor 6, input circuit 13, decision circuit 14, which are connected to an input side of the buzzer 20, and the switch 7 connected to an output side of the buzzer 20.

Assuming the vehicle is stopped and the switch 7 is closed, the lead switch **6*b* of the vehicular speed sensor 6 remains opened or closed, the decision circuit 14 determines that the vehicle is in a stopped condition and generates a high level signal. If a driver starts the engine and then depresses an accelerator pedal (not shown) to carry out a warming-up operation, and the accelerator pedal continues to be depressed even after the warming-up operation of the engine is completed, and the temperature of the engine increases over the afore-mentioned predetermined temperature and the temperature switch 5 is closed. As a result, the input circuit 12 generates a high level signal, and the transistor $Tr_1$ turns ON which turns on the indication lamp 8**, thus informing the driver that the temperature of the engine has reached a high temperature.

At the same time when the output signal from the input circuit 12 becomes high, the timer circuit 16 is operated to generate a high level signal after a predetermined timer setting time has elapsed. When the latch circuit 17 receives the high level signal, it is operated to continue to generate the high level signal. As a result, the transistor $Tr_2$ turns ON, and the buzzer 20 is operated to sound an alarm, thus informing the driver that the temperature of the engine has increased. Then, when the driver operates the shift lever in a driving position, or releases the parking brake so as to start driving the vehicle, the switch 7 is opened, and accordingly the buzzer 20 is stopped.

Further, malfunctions due to a noise or the like may be prevented by using the timer circuit 16.

During running of the vehicle, when the temperature of the engine cooling water is decreased by the radiator, below predetermined temperature, the temperature switch 5 is opened to turn off the indication lamp 8.

Figure 2:
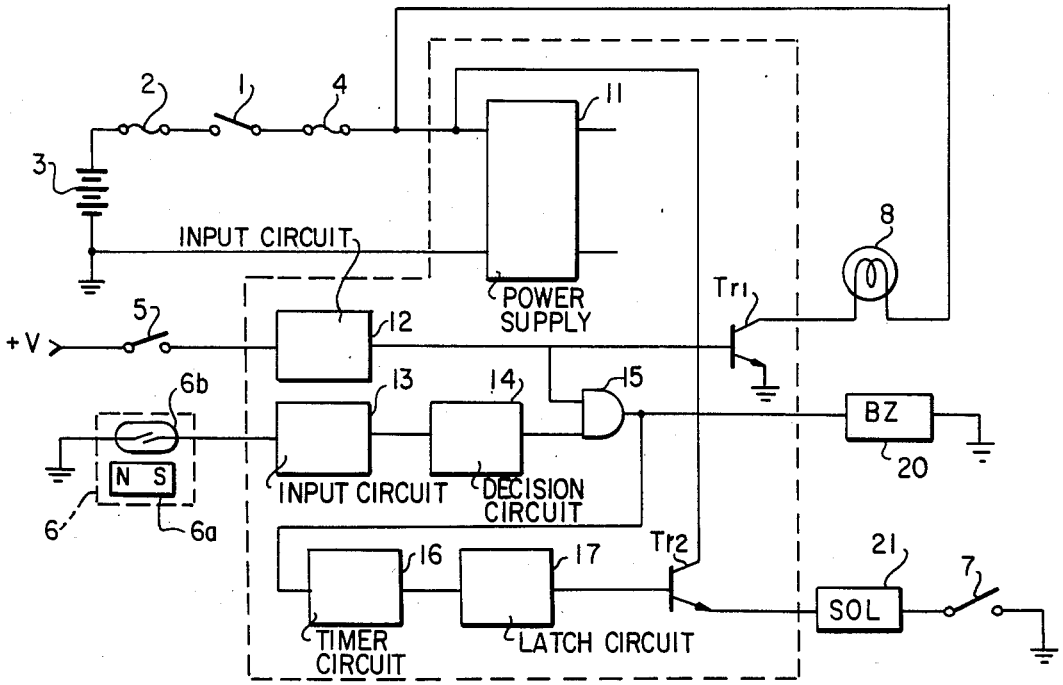
FIG. 2 is a block diagram showing another embodiment according to the present invention.

Referring to FIG. 2, which shows another embodiment of the control device for engine operation conditions according to the present invention, the buzzer 20 is connected directly to an output terminal of the AND circuit 15. One side of a solenoid for a fuel cut device, such as a fuel cutting electromagnetic valve 21, is connected to the emitter of the transistor $Tr_2$, while the other side is connected to the switch 7. The electromagnetic valve 21 is normally open valve provided in a fuel passage. The valve is opened upon deenergization of the solenoid to allow fuel to pass therethrough and is closed upon energization of the solenoid to cut the fuel and stop the engine.

According to the above-mentioned circuit, when the engine temperature is increased while the vehicle is stopped and the temperature switch 5 is closed, the indication lamp 8 is turned on and simultaneously the buzzer 20 is operated to sound the alarm. When a driver does not start the vehicle during the time period the timer circuit 16 regardless of the alarm of the buzzer 20, the electromagnetic valve 21 is energized to cut the fuel supply to the engine, thus stopping the engine. As a result, a further increase in engine temperature may be prevented. As is similar to the embodiment of FIG. 1, the timer circuit has the function of preventing the malfunction of the electromagnetic valve 21 due to noise or the like, and simultaneously cutting the fuel after generation of the alarm by the buzzer 20 to inform the driver of such a situation.

According to the present invention, a vehicle stop sensor is provided for detecting a stopped condition of the vehicle, a temperature sensor is provided for detecting an engine temperature, and a drive circuit is provided for receiving signals from these sensors and operating an alarm device and/or a fuel cut device when the vehicle is in a stopped condition and the engine temperature exceeds a predetermined temperature. Accordingly, it is possible to prevent the engine temperature from increasing to a temperature higher than the predetermined temperature especially during a warming-up operation. As a result, poor engine operation and a waste of fuel may be prevented.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

We claim:

1. An operational condition control device for an internal combustion engine for operating an alarm means when the engine temperature exceeds a predetermined temperature, said operational condition control device comprising a vehicle stop sensor means for detecting a stopped condition of a vehicle, a temperature sensor means for detecting engine temperature, and a drive circuit means coupled to the outputs of said stop sensor means and said temperature sensor means for receiving signals from said sensors and operating said alarm means when the vehicle is in the stopped condition, and said engine temperature exceeds the predetermined temperature.

2. The operational condition control device as defined in claim 1, wheren said vehicle stop sensor means detects when the vehicular speed is lower than a predetermined value, and when the vehicle transmission is in a neutral position.

3. The operation condition control device as defined in claim 1, wherein said vehicle stop sensor means detects when the vehicular speed is lower than a predetermined speed, and when the vehicle parking brake is in an operational condition.

4. The operational condition control device as set forth in claim 1, wherein said drive circuit means includes delay circuit means coupled to said vehicle stop sensor means for delaying the operation of said alarm means for a predetermined time after the detection of a stopped condition by said stop sensor means.

5. An operational condition control device for an internal combustion engine for operating an engine output decreasing means when the engine temperature exceeds a predetermined temperature to stop the engine, said operational condition control device comprising a vehicle stop sensor means for detecting a stopped condition of a vehicle, a temperature sensor means for detecting engine temperature, and a drive circuit means coupled to the outputs of said stop sensor means and said temperature sensor means for receiving signals from said sensors and operating said engine output decreasing means when the vehicle is in the stopped condition and said engine temperature exceeds the predetermined temperature.

6. The operational condition control device as defined in claim 5, wherein said engine output decreasing means is a normally open valve in a fuel passage of the engine.

7. The operational condition control device as defined in claim 5, wherein said vehicle stop sensor means detects when the vehicular speed is lower than a predetermined value, and when the vehicle transmission is in a neutral position.

8. The operation condition control device as defined in claim 5, wherein said vehicle stop sensor means detects when the vehicular speed is lower than a predetermined speed, and when the vehicle parking brake is in an operational condition.

9. The operational condition device as defined in claim 5 or 6, wherein said vehicle stop sensors are connected to both side of said engine output decreasing means.

10. An operational condition control device for an internal combustion engine for operating an alarm means when the engine temperature exceeds a predetermined temperature and for operating an engine output decreasing means to stop the engine, said operational condition control device comprising a vehicle stop sensor means for detecting a stopped condition of a vehicle, a temperature sensor means for detecting engine temperature, and a drive circuit means coupled to the outputs of said temperature sensor means and said stop sensor means for receiving signals from said sensors, and for operating said alarm means and operating said engine output decreasing means after a predetermined time has elapsed after the operation of said alarm means when the vehicle is in a stopped condition and the engine temperature exceeds the predetermined temperature.

11. The operation condition control device as defined in claim 10, wherein said engine output decreasing means is a normally open valve in a fuel passage of the engine.

12. The operational condition control device as defined in claim 10, wherein said vehicle stop sensor means detects when the vehicular speed is lower than a predetermined value, and when the vehicle transmission is in a neutral position.

13. The operational condition control device as defined in claim 10, wherein said vehicle stop sensor means detects when the vehicular speed is lower than a predetermined speed, and when the vehicle parking brake is in an operational condition.

14. The operational condition control device as set forth in claim 10, further including delay circuit means coupled to the input of said engine output decreasing means for providing the predetermined time delay in the operation of said engine output decreasing means.

* * * * *